US011795971B2

(12) United States Patent
Groeschel

(10) Patent No.: US 11,795,971 B2
(45) Date of Patent: Oct. 24, 2023

(54) THERMAL BARRIER

(71) Applicant: KSB SE & Co. KGaA, Frankenthal (DE)

(72) Inventor: Juergen Groeschel, Frankenthal (DE)

(73) Assignee: KSB SE & Co. KGaA, Frankenthal (DE)

( * ) Notice: Subject to any disclaimer, the term of this patent is extended or adjusted under 35 U.S.C. 154(b) by 127 days.

(21) Appl. No.: 17/594,068

(22) PCT Filed: Mar. 5, 2020

(86) PCT No.: PCT/EP2020/055836
§ 371 (c)(1),
(2) Date: Oct. 1, 2021

(87) PCT Pub. No.: WO2020/200624
PCT Pub. Date: Oct. 8, 2020

(65) Prior Publication Data

US 2022/0154730 A1 May 19, 2022

(30) Foreign Application Priority Data

Apr. 2, 2019 (DE) ..... 10 2019 002 392.7

(51) Int. Cl.
*F04D 29/58* (2006.01)
*F04D 13/02* (2006.01)
*F04D 29/62* (2006.01)

(52) U.S. Cl.
CPC ..... *F04D 29/58* (2013.01); *F04D 13/026* (2013.01); *F04D 29/62* (2013.01)

(58) Field of Classification Search
CPC .. F04D 13/024; F04D 13/025; F04D 13/0606; F04D 13/02; F04D 29/58
See application file for complete search history.

(56) References Cited

U.S. PATENT DOCUMENTS 4,080,112 A * 3/1978 Zimmermann ..... F04D 13/025 415/218.1
4,890,988 A * 1/1990 Kramer ..... F04D 13/0626 417/372

(Continued)

FOREIGN PATENT DOCUMENTS

DE 296 10 798 U1 2/1997
DE 298 14 113 U1 10/1998

(Continued)

OTHER PUBLICATIONS

International Search Report (PCT/ISA/210) issued in PCT Application No. PCT/EP2020/055836 dated May 29, 2020 with English translation (five (5) pages).

(Continued)

*Primary Examiner* — David E Sosnowski
*Assistant Examiner* — Jackson N Gillenwaters
(74) *Attorney, Agent, or Firm* — Crowell & Moring LLP

(57) ABSTRACT

A pump arrangement including a magnetic clutch pump arrangement, the pump arrangement including an inner chamber formed by a housing arrangement, a separating can which hermetically seals a chamber enclosed by it with respect to the inner chamber, an impeller shaft that can be driven in rotation about an axis of rotation, an impeller arranged on one end of the impeller shaft, an inner rotor arranged on the other end of the impeller shaft, a drive device, a drive shaft that can be driven in rotation about the axis of rotation by the drive device, and an outer rotor arranged on the drive shaft and cooperating with the inner rotor. The outer rotor includes a first carrier element and a second carrier element connected to the first carrier element. The first carrier element includes a thermal barrier device.

12 Claims, 5 Drawing Sheets

(56) References Cited

U.S. PATENT DOCUMENTS

| | | | | |
|---|---|---|---|---|
| 6,997,688 | B1 * | 2/2006 | Klein | F04D 29/126 417/420 |
| 9,869,316 | B2 * | 1/2018 | Drechsel | F04D 13/0626 |
| 10,288,073 | B2 * | 5/2019 | Drechsel | F04D 29/588 |
| 2016/0108923 | A1 | 4/2016 | Drechsel et al. | |

FOREIGN PATENT DOCUMENTS

| | | | |
|---|---|---|---|
| DE | 100 57 183 | A1 | 5/2002 |
| DE | 10 2009 033 111 | A1 | 2/2011 |
| DE | 10 2013 008 795 | B3 | 8/2014 |
| EP | 0 814 268 | A1 | 12/1997 |
| EP | 0 814 268 | B1 | 3/2001 |
| EP | 1 207 308 | A2 | 5/2002 |
| RU | 2 368 811 | C2 | 9/2009 |
| RU | 2 472 038 | C2 | 1/2013 |
| RU | 2 679 070 | C2 | 2/2019 |
| WO | WO 2017/162775 | A1 | 9/2017 |

OTHER PUBLICATIONS

German-language Written Opinion (PCT/ISA/237) issued in PCT Application No. PCT/EP2020/055836 dated May 29, 2020 (five (5) pages).

German-language Office Action issued in German Application No. 10 2019 002 392.7 dated Jan. 31, 2020 (eight (8) pages).

International Preliminary Report on Patentability (PCT/IB/338 & PCT/IB/373) issued in PCT Application No. PCT/EP2020/055836 dated Oct. 14, 2021, including English translation of document C2 (German-language Written Opinion (PCT/ISA/237), filed on Oct. 1, 2021) (six (6) pages).

Hindi-language Office Action issued in Indian Application No. 202137042401 dated Jan. 31, 2023 with English translation (five (5) pages).

Cover Page of EP 3 433 496 A1 published Jan. 30, 2019 (one (1) page).

Russian-language Search Report issued in Russian Application No. 2021128863/12(061193) dated Jun. 29, 2023 (2 pages).

* cited by examiner

THERMAL BARRIER

BACKGROUND AND SUMMARY OF THE INVENTION

The invention relates to a pump arrangement, in particular a magnetic clutch pump arrangement, having an inner space which is formed by means of a housing arrangement, a containment can which hermetically seals a chamber which is surrounded by it with respect to the inner space formed by the housing arrangement, an impeller shaft which can be rotatably driven about a rotation axis, an impeller which is arranged at one end of the impeller shaft, an internal rotor which is arranged at the other end of the impeller shaft, a drive device, a drive shaft which can be rotatably driven by the drive device about the rotation axis and an external rotor which is arranged on the drive shaft and which cooperates with the internal rotor, wherein the external rotor has a first carrier element and a second carrier element which is connected to the first carrier element.

Such pump arrangements are commonplace and are used in almost all sectors of industry. Machines of the present type are also used in areas which are at risk of explosion. For the different production and conveying units, in particular in the chemical sector, there are specific provisions in connection with explosion protection. In such units, on the one hand, working machines, for example, pumps or turbines, are used as non-electrical devices and, on the other hand, power engines, for example, drive motors, are used as electrical devices. For electrical devices there are safety standards which have been found to be advantageous for some time. In these standards it is prescribed which structural measures must be taken in order to be able to use an electrical device in the different areas at risk of explosion. In such spaces, in which it is possible for an atmosphere which is capable of explosion to be produced, the ignition sources, that is to say, the production of friction and impact sparks, friction heat and electrical charging have to be prevented and possible effects of an explosion have to be taken into account by means of preventive and structural measures. Explosion-protected block motors, in particular standard motors of flange construction type, permit at the interfaces, in particular the flange and shaft, only a specific thermal input into the motor in such a manner that the maximum permissible temperatures of the motor are not exceeded.

In the meantime, it is known that, with magnetic clutch pump arrangements, the main thermal input into the drive motor is carried out by means of the drive shaft thereof since the external magnet carrier of the magnetic clutch is subjected both to the media temperature and the temperature increase resulting from the eddy current losses. Owing to the poor thermal discharge of the external magnet carrier resulting from the pump housing which has also been heated, the thermal energy is introduced to a large extent directly into the drive shaft.

In DE 298 14 113 U1, this problem is avoided by the external rotor which is referred to as a driver and the drive motor being drivingly connected by way of a driving means made of material with poor heat conductivity. A disadvantage in this instance is the cost-intensive embodiment with an interposed external rotor. This is because, in addition to components which are further required, in addition to the motor roller bearing the deep groove ball bearings which support the external rotor also have to be maintained. Furthermore, the heat blocking function exists only at the interface to the motor shaft end. Since the heat is introduced directly into the inner ring of the deep groove ball bearing, however, the inner ring expands and the bearing is thus tensioned and consequently the service-life is reduced. In an embodiment which operates with coolant, the external rotor runs in the coolant, whereby considerable friction losses which significantly reduce the efficiency of the pump are produced.

An object of the invention is to provide a pump arrangement in which the thermal flow into the drive shaft which is supported in a bearing carrier and consequently into the inner rings of the roller bearing is minimized.

The object of the invention is achieved in that the first carrier element has a thermal barrier device. The thermal barrier device reduces the thermal input from the containment can into the drive shaft of the external rotor and into the bearings by means of which the drive shaft is supported in the bearing carrier.

According to an embodiment of the invention, the first carrier element comprises an annular disk having a hub for securing to the drive shaft, wherein a collar which extends axially in the direction of the containment can is provided on the annular disk.

An advantageous embodiment makes provision for the thermal barrier device to be arranged inside the collar.

As a result of the collar and the arrangement of the thermal barrier device inside the collar, an optimal positioning of the thermal barrier device is possible.

An embodiment has been found to be particularly advantageous according to which the thermal barrier device comprises a thermal insulation element and a thermal reflection element. Consequently, the thermal input into the first carrier element and the drive shaft can be efficiently reduced.

Ideally, the thermal insulation element is constructed substantially as a circular-cylindrical member.

An embodiment has been found to be particularly advantageous according to which the thermal reflection element is constructed substantially as a circular-disk-like-plate.

As a result of the circular configuration, the outer covering faces of the thermal insulation element and thermal reflection element can abut the inner covering face of the collar and reduce the thermal input into the first carrier element and the drive shaft.

Advantageously, the thermal insulation element abuts the annular disk of the carrier element and the thermal reflection element abuts the thermal insulation element and is arranged between the containment can and the thermal insulation element. In this manner, it is possible for the heat radiation which is discharged from the containment can to be reflected back and the heat flow into the drive shaft can be very significantly reduced.

In order to securely fix the thermal barrier device to the first carrier element, a screw-like securing means is provided.

Alternatively or in combination with the screw-like securing means, in order to secure the thermal barrier device to the first carrier element, a threaded-bolt-like securing means is provided.

Alternatively or in combination with the screw-like or threaded-bolt-like securing means, in order to secure the thermal barrier device to the first carrier element, a rivet-like securing means is provided.

In an alternative embodiment, the inner covering face of the collar has a radially circumferential groove in which a securing ring is placed. The securing ring prevents axial movement of the thermal barrier device.

Embodiments of the invention are illustrated in the drawings and are described in greater detail below.

DETAILED DESCRIPTION

Figure 1:
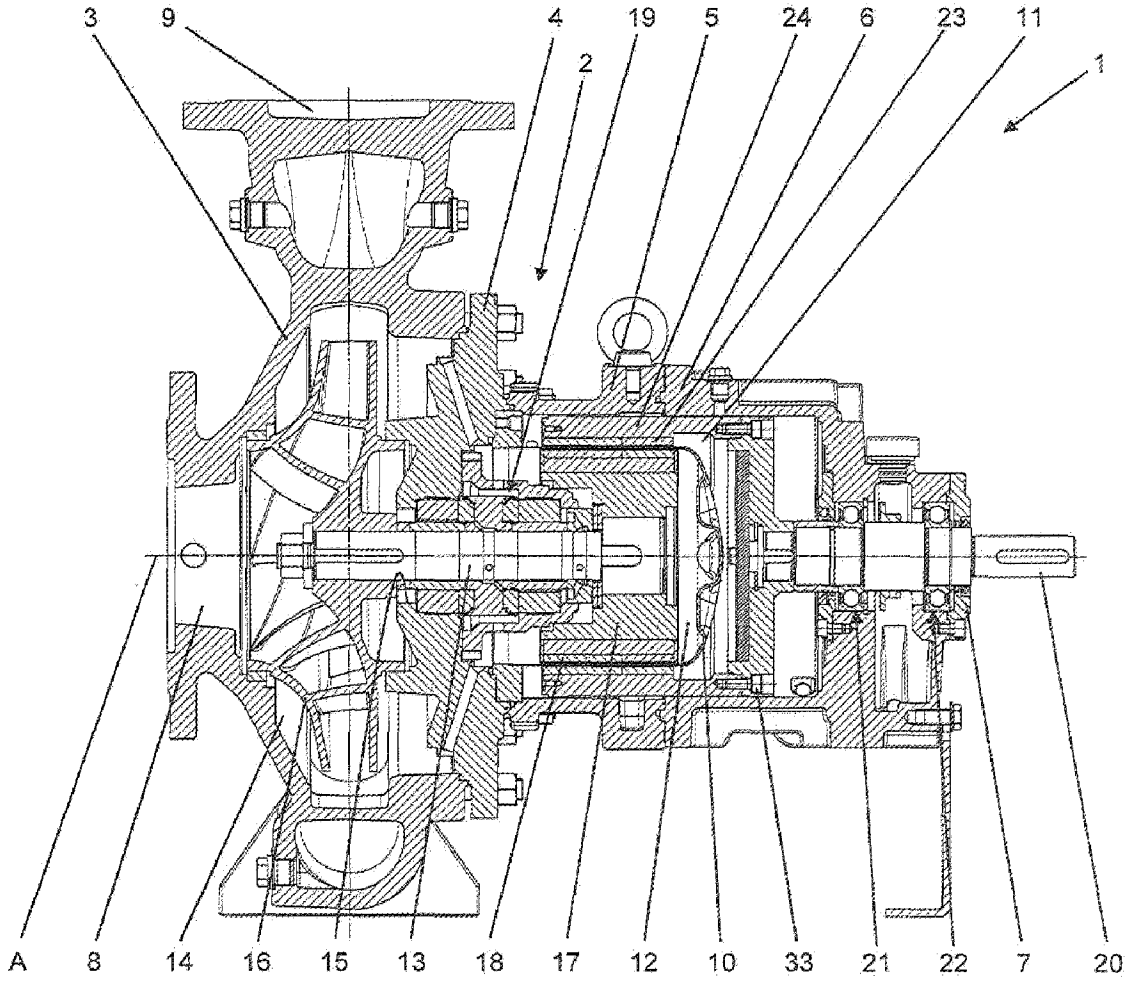
FIG. 1 is a longitudinal section through a magnetic clutch pump arrangement having an external rotor which has a thermal barrier device in accordance with an embodiment of the present invention.

FIG. 1 shows a pump arrangement 1 in the form of a magnetic clutch pump arrangement. The pump arrangement 1 has a multi-component housing arrangement 2 having a hydraulic housing 3 constructed as a helical housing, a housing cover 4, a bearing carrier lantern member 5, a bearing carrier 6 and a bearing cover 7.

The hydraulic housing 3 has an inlet opening 8 for drawing in a conveying medium and an outlet opening 9 for discharging the conveying medium. The housing cover 4 is arranged at the side of the hydraulic housing 3 opposite the inlet opening 8. At the side of the housing cover 4 facing away from the hydraulic housing 3, the bearing carrier lantern member 5 is secured. The bearing carrier 6 is fitted to the side of the bearing carrier lantern member 5 opposite the housing cover 4. The bearing carrier cover 7 is in turn secured to the side of the bearing carrier 6 facing away from the bearing carrier lantern member 5.

A containment can 10 which is preferably produced by means of a deep-drawing method or by means of a casting method is secured to the side of the housing cover 4 facing away from the hydraulic housing 3 and extends at least partially through an inner space 11 which is delimited by the housing cover 4, the bearing carrier lantern member 5 and the bearing carrier 6. The containment can 10 hermetically seals a chamber 12 which is surrounded by it with respect to the inner space 11.

An impeller shaft 13 which can be rotated about a rotation axis A extends from a flow chamber 14 which is delimited by means of the hydraulic housing 3 and the housing cover 4 through an opening 15 provided in the housing cover 4 into the chamber 12.

At a shaft end of the impeller shaft which is located inside the flow chamber 14, there is secured an impeller 16. At the opposing shaft end an internal rotor 17 which is arranged inside the chamber 12 is arranged. The internal rotor 17 is provided with a plurality of magnets 18 which are arranged at the side of the internal rotor 17 facing the containment can 10.

A bearing arrangement 19 which is actively connected to the impeller shaft 13 which can be rotatably driven about the rotation axis A is arranged between the impeller 16 and the internal rotor 17.

A drive device which is not illustrated, for example, a drive motor, preferably an electric motor, drives a drive shaft 20. The drive shaft 20 which can be rotatably driven about the rotation axis A is arranged substantially coaxially with the impeller shaft 13. The drive shaft 20 extends through the bearing cover 7 and the bearing carrier 6 and is supported in two ball bearings 21, 22 which are accommodated in the bearing carrier 6. At the free end of the drive shaft 20, an external rotor 24 which carries a plurality of magnets 23 is arranged. The magnets 23 are arranged at the side of the external rotor 24 facing the containment can 10. The external rotor 24 extends at least partially over the containment can 10 and cooperates with the internal rotor 17 in such a manner that the rotating external rotor 24 by means of magnetic forces also moves the internal rotor 17 and consequently the impeller shaft 13 and the impeller 16 in rotation.

Figure 2:
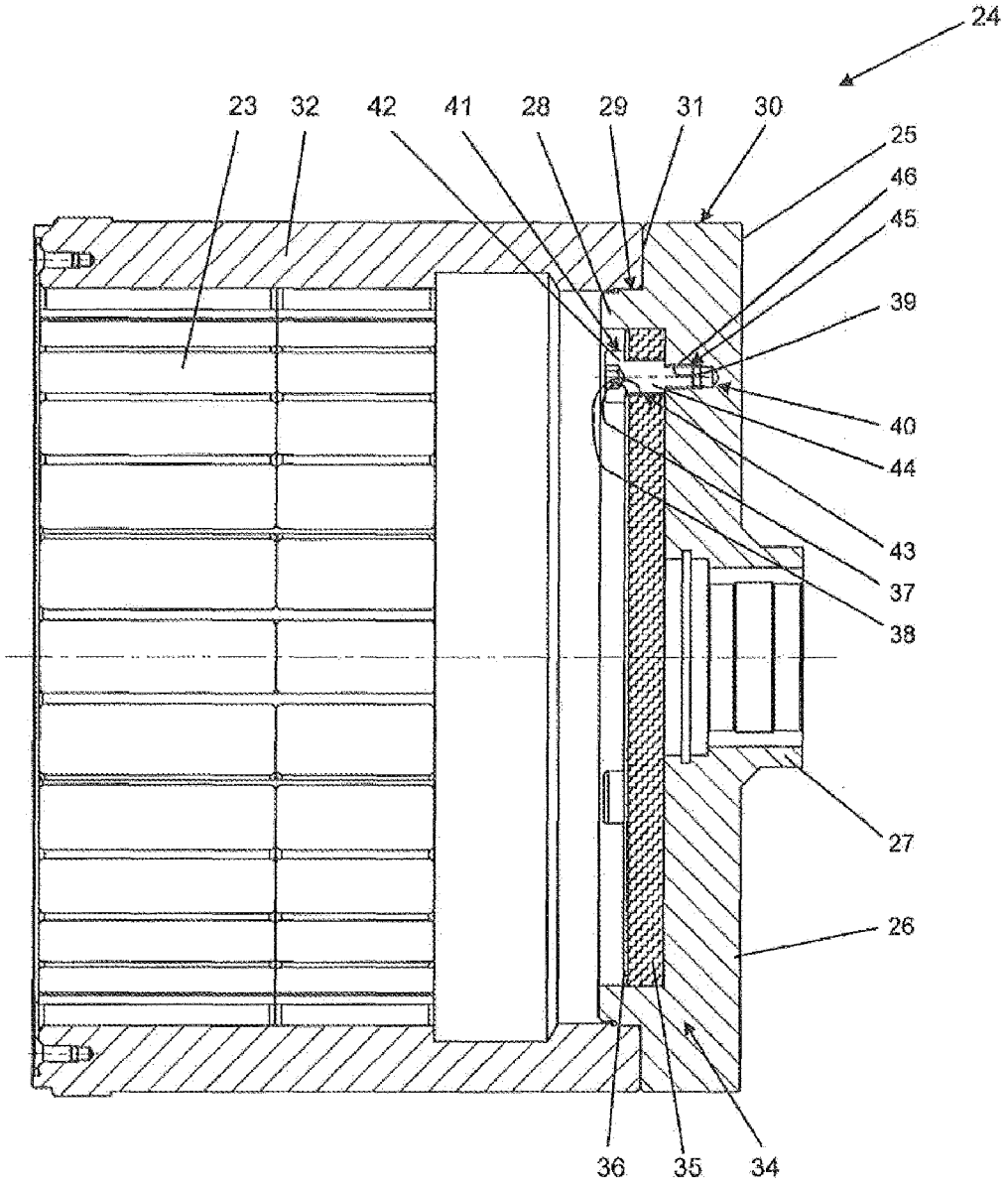
FIG. 2 is an enlarged illustration of the external rotor shown in FIG. 1, and FIGS. 3 to 5 show further embodiments of the external rotor.

The external rotor 24 illustrated to an enlarged scale in FIG. 2 comprises a first carrier element 25. The first carrier element 25 comprises an annular disk 26 having a hub 27, wherein the hub 27 is pushed onto the drive shaft 20 shown in FIG. 1 and is secured thereto using suitable means. On the annular disk 26, there is formed an annular collar 28 which extends axially in the direction of the containment can 10 or housing cover 4. The collar 28 has a smaller outer diameter than the annular disk 26. Consequently, the first carrier element 25 has a region 29 having a reduced outer diameter and a region 30 having an increased outer diameter, whereby a step 31 is formed.

The external rotor 24 further comprises a hollow-cylindrical second carrier element 32 which is formed or arranged on the first carrier element 25 and which at least partially surrounds the containment can 10 and on which the magnets 23 are arranged.

In order to secure the second carrier element 32 to the first carrier element 25, the second carrier element 32 is pushed over the collar 28, that is to say, the region 29 of the first carrier element 25 with a reduced outer diameter, wherein the step 31 forms a stop device.

Using screws 33 which are shown in FIG. 1, the second carrier element 32 is secured to the first carrier element 25.

The first and second carrier elements 25, 32 are illustrated as two components which can be connected to each other by means of a screw connection. Alternatively, the two components may be connected to each other by means of shrinking technology. In another exemplary variant, the first carrier element 25 and the hollow-cylindrical portion of the second carrier element 32 may be constructed in an integral manner.

As can further be seen in FIG. 2, the first carrier element 25 has a thermal barrier device 34. The thermal barrier device 34 is arranged inside the collar 28. The thermal barrier device 34 comprises a thermal insulation element 35 and a thermal reflection element 36. The thermal insulation element 35 is constructed substantially as a circular-cylindrical member and is produced from a material with very poor thermal conductivity, for example, mica. The thermal reflection element 36 is constructed substantially as a disk-like plate and is produced from a material with a high degree of heat reflection, for example, a high-grade steel alloy.

The thermal insulation element 35 abuts the annular disk 26 of the carrier element 25. The heat reflection element 36 in turn abuts the thermal insulation element 35 and is consequently arranged in the installed state between the containment can 10 and the thermal insulation element 35 in order to reflect back the thermal radiation originating from the containment can 10. In this manner, the heat flow into the drive shaft 20 can be very significantly reduced. Preferably, the outer covering faces of the thermal insulation element 35 and the thermal reflection element 36 abut the inner covering face of the collar 28.

In order to secure the thermal barrier device 34 to the first carrier element 25, in the embodiment shown at least one through-hole 37 is provided in the thermal reflection element 36 and at least one through-hole 38 is provided in the thermal insulation element 35, wherein both through-holes 37, 38 are arranged so as to overlap. The annular disk 28 of the first carrier element 25 has at least one threaded hole 39. Both through-holes 37, 38 are arranged to be located over the threaded hole 39 in such a manner that a securing means 40 which in the embodiment shown is constructed in a screw-like manner, extends through both through-holes 37, 38 and can be screwed into the threaded hole 39. Preferably, two or more through-holes 37, 38 and threaded holes 39 are provided.

The at least one securing means 40 is divided into three portions with different outer diameters. A first portion 41 forms a head 42. A second portion 43 forms a shaft 44 which is connected to the head 42. A third portion 45 which adjoins the second portion 43 is provided with an outer thread 46. The outer diameter of the head 42 is larger than the outer diameter of the shaft 44. The outer diameter of the shaft 44 is in turn larger than the outer diameter of the outer thread 46.

The length of the shaft 44 is slightly smaller than the overall thickness of the heat reflection element 36 and the thermal insulation element 35 when they are not yet installed. In this manner, the thermal reflection element 36 and thermal insulation element 35 can be securely fixed to the annular disk 26 of the first carrier element 25 with a defined pretensioning.

Figure 3:
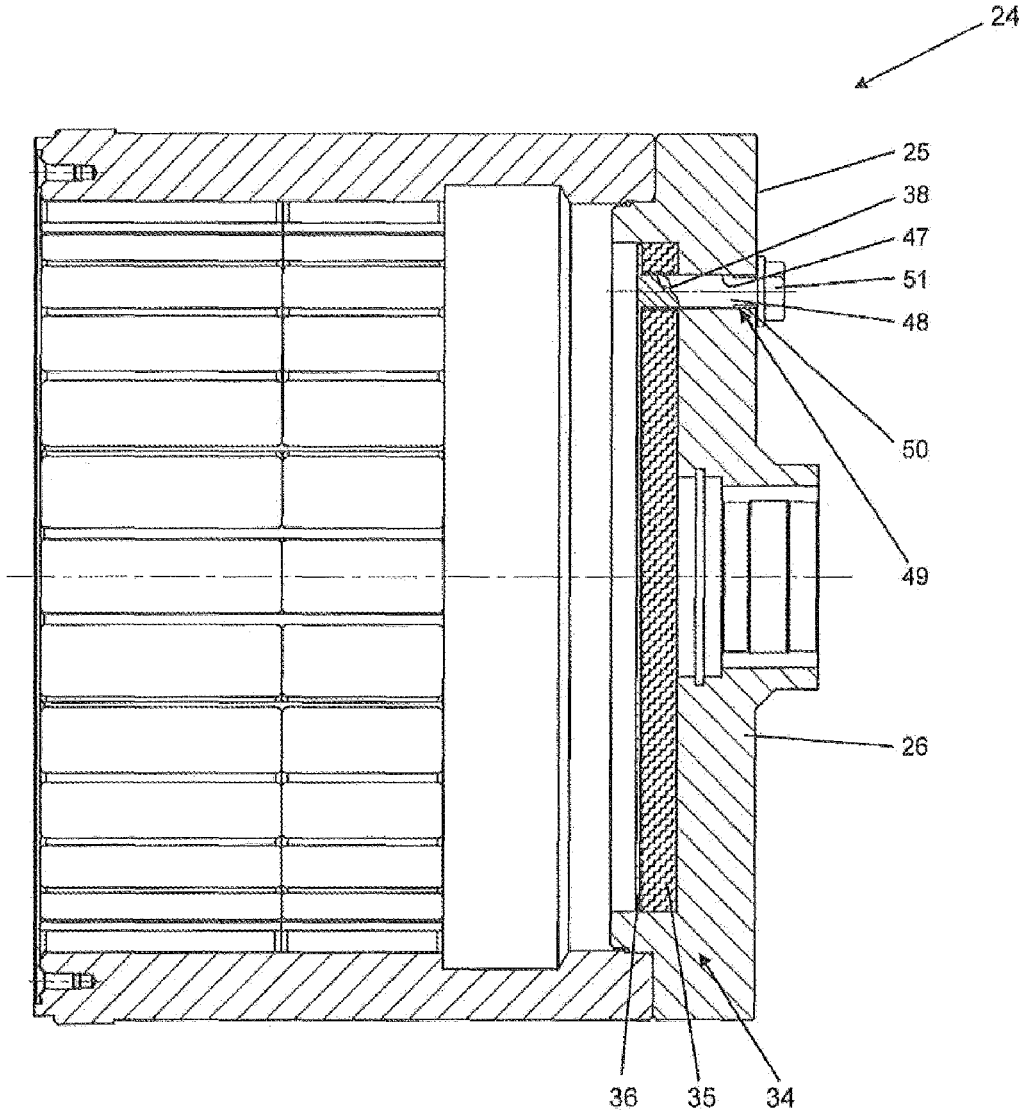

In another exemplary embodiment illustrated in FIG. 3, the annular disk 26 of the external rotor 24 has at least one through-hole 47 which overlaps the through-hole 38 in the thermal insulation element 35. A threaded-bolt-like securing means 48 which is constructed on the thermal reflection element 36 extends through the through-hole 38 and through the through-hole 47 of the annular disk 26. The securing means 48 has at the free end thereof a region 49 having a thread 50. By means of a screw nut 51 which can be screwed onto the securing means 48, the thermal barrier device 34 can be secured to the first carrier element 25. Preferably, two or more through-holes 38 are provided in the thermal insulation element 35 and in the annular disk 26, and a corresponding number of securing means 48.

Figure 4:
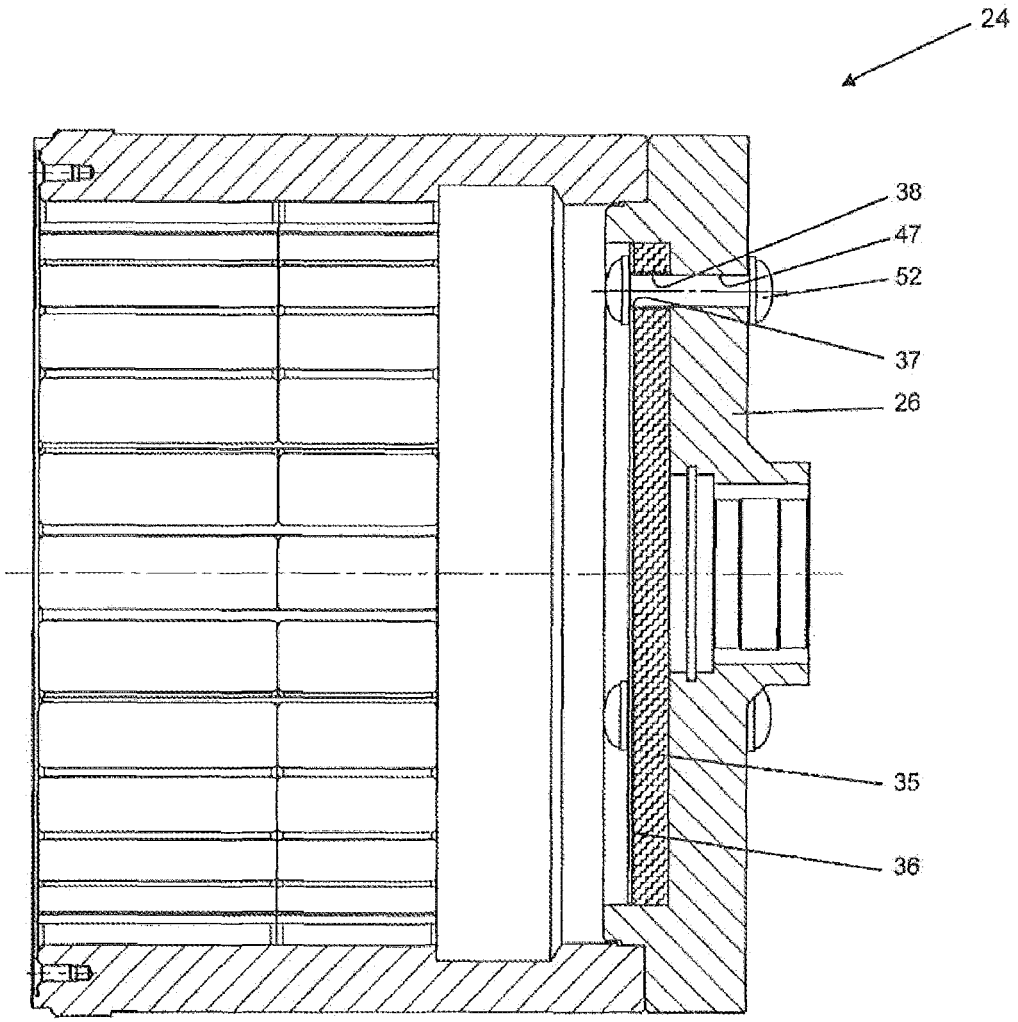

Alternatively or in combination with at least one of the securing means 40 and/or 48, a rivet-like securing means 52 which is shown by way of example in FIG. 4 can also be used. In this case, at least one through-hole 37 is provided in the thermal reflection element 36, at least one through-hole 38 is provided in the thermal insulation element 35 and at least one through-hole 47 is provided in the annular disk 26 of the external rotor 24, wherein the through-holes 37, 38 and 47 are arranged overlapping each other.

Figure 5:
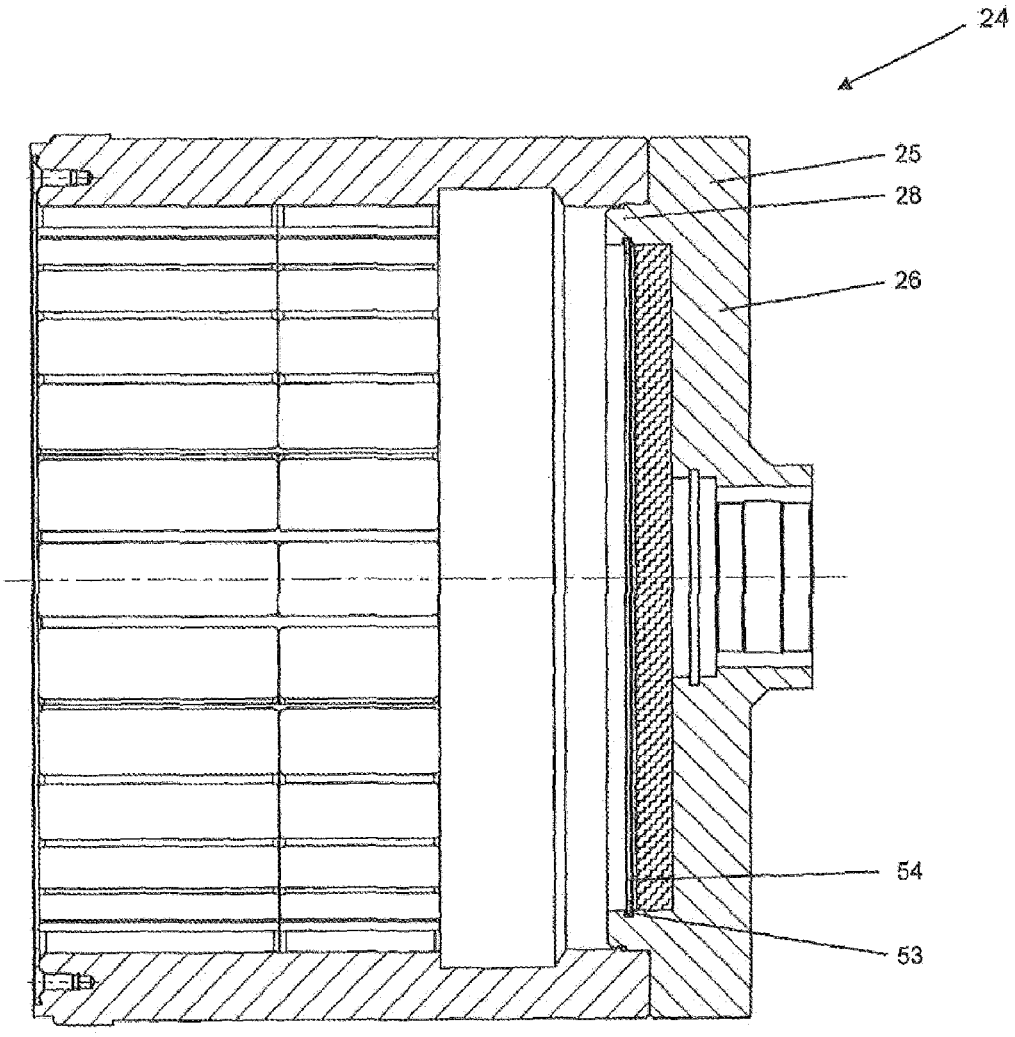

In another exemplary embodiment of the external rotor 24 shown in FIG. 5, the inner covering face of the collar 28 formed on the annular disk 26 of the first carrier element 25 has a radially circumferential groove 53 in which a securing ring 54 is placed. This securing ring 54 inserted in the groove 53 prevents an axial movement of the thermal barrier device 34.

In the embodiment illustrated in FIG. 1, the drive shaft 20 is connected by means of a coupling device to the output shaft of a motor which is not illustrated, in particular an electric motor. The invention can, for example, also be used in a pump arrangement which is constructed with the so-called block design and in which the first carrier element is secured directly to the output shaft of the motor.

The invention claimed is:

1. A pump arrangement having a magnetic clutch, comprising:
   - a housing arrangement having an inner space in which the magnetic clutch is arranged;
   - a containment can arranged in the inner space, the containment can being configured to hermetically seal a chamber within the containment can;
   - an impeller shaft configured to be rotatably driven about a rotation axis;
   - an impeller arranged at one end of the impeller shaft;
   - an internal rotor arranged at an opposite end of the impeller shaft;
   - a drive shaft configured to be rotatably driven about the rotation axis; and
   - an external rotor concentrically around the containment can and being configured to cooperate with the internal rotor inside the containment can to rotate the impeller shaft, wherein the external rotor has a first carrier element and a second carrier element connected to the first carrier element, and
   - the first carrier element has a thermal barrier.

2. The pump arrangement as claimed in claim 1, wherein the first carrier element includes
   - an annular disk having a hub configured to be secured to the drive shaft, and
   - a collar extending axially toward the containment can.

3. The pump arrangement as claimed in claim 2, wherein the thermal barrier is arranged radially inward of the collar.

4. The pump arrangement as claimed in one of claim 3, wherein
   - the thermal barrier includes a thermal insulation element and a thermal reflection element.

5. The pump arrangement as claimed in claim 4, wherein the thermal insulation element is circular-cylindrical.

6. The pump arrangement as claimed in claim 5, wherein the thermal reflection element is a disk-shaped plate.

7. The pump arrangement as claimed in claim 6, wherein
   - the thermal insulation element abuts the annular disk of the first carrier element, and
   - the thermal reflection element abuts the thermal insulation element and is arranged between the containment can and the thermal insulation element.

8. The pump arrangement as claimed in claim 7, wherein the thermal barrier is secured to the first carrier element by at least one screw.

9. The pump arrangement as claimed in claim 7, wherein the thermal barrier is secured to the first carrier element by at least one threaded bolt.

10. The pump arrangement as claimed in claim 7, wherein the thermal barrier is secured to the first carrier element by at least one rivet.

11. The pump arrangement as claimed in claim 7, wherein the thermal barrier is secured to the first carrier element by an interference fit between a radially inner surface of the second carrier element and a radially outer surface of the first carrier element collar.

12. The pump arrangement as claimed in claim 7, wherein the thermal barrier is secured to the first carrier element a securing ring configured to be received in a radially circumferential groove formed on a radially inner surface of the first carrier element collar.

* * * * *